US005990835A

United States Patent [19]

Kuntzsch et al.

[11] Patent Number: 5,990,835

[45] **Date of Patent: *Nov. 23, 1999**

[54] ANTENNA ASSEMBLY

[75] Inventors: Tilmann Kuntzsch, Ulm, Germany; Stuart Dean, Nepean; Michael Leonard Purdy, Stittsville, both of Canada

[73] Assignee: Northern Telecom Limited, Montreal, Canada

[ * ] Notice: This patent issued on a continued prosecution application filed under 37 CFR 1.53(d), and is subject to the twenty year patent term provisions of 35 U.S.C. 154(a)(2).

[21] Appl. No.: 08/896,222

[22] Filed: Jul. 17, 1997

[51] Int. Cl.[6] ..... H01Q 1/38; H01Q 1/42

[52] U.S. Cl. ..... 343/700 MS; 343/872; 343/846

[58] Field of Search ..... 343/700 MS, 829, 343/872, 846, 848; H01Q 1/38

[56] References Cited

U.S. PATENT DOCUMENTS

| | | | |
|---|---|---|---|
| 4,816,835 | 3/1989 | Abiko et al. | 343/700 MS |
| 4,829,309 | 5/1989 | Tsukamoto et al. | 343/700 MS |
| 5,181,042 | 1/1993 | Kaise et al. | 343/700 MS |
| 5,438,697 | 8/1995 | Fowler et al. | 343/700 MS |
| 5,453,751 | 9/1995 | Tsukamoto et al. | 343/700 MS |
| 5,477,231 | 12/1995 | Medard | 343/700 MS |
| 5,499,033 | 3/1996 | Smith | 343/700 MS |

FOREIGN PATENT DOCUMENTS

| | | |
|---|---|---|
| 0 301 580 A2 | 7/1988 | European Pat. Off. . |
| 0 342 175 A2 | 5/1989 | European Pat. Off. . |
| 0 384 777 A2 | 2/1990 | European Pat. Off. . |
| 0 427 479 A2 | 11/1990 | European Pat. Off. . |
| 0 521 377 A2 | 6/1992 | European Pat. Off. . |
| WO 96/19844 | 6/1996 | WIPO . |

*Primary Examiner*—Don Wong
*Assistant Examiner*—Tan Ho
*Attorney, Agent, or Firm*—Lee, Mann, Smith, McWilliams, Sweeney & Ohlson

[57] ABSTRACT

The present invention relates to integral antenna assemblies and in particular relates to an integral antenna assembly for microcellular base stations and fixed wireless access base stations. In accordance with one aspect of the invention, there is provided an integral antenna comprising a radome, a layered antenna and a reflector back plane, wherein the layered antenna has an outer surface and a rear surface; wherein the radome is attached directly to an outer surface of the antenna; and wherein the back plane provides a reflective cavity and encloses the feed network for the antenna and is attached to the rear surface of the antenna. In accordance with another aspect of the invention there is provided method of operating an integral antenna comprising a radome, a dielectric substrate having a patch antenna element on a surface thereof and a reflector back plane providing a reflective cavity behind the radiating element; wherein the radome is attached directly to an outer surface of the dielectric and the reflector back plane is attached to a rear surface of the dielectric, the patch being connected through the substrate to a microstrip feed line, whereby the microstrip feed line lies parallel to the patch, with the patch acting as a ground with respect to the microstrip line, wherein the antenna transmits and receives signals via the feed network.

11 Claims, 9 Drawing Sheets

ANTENNA ASSEMBLY

FIELD OF THE INVENTION

The present invention relates to antennas and in particular, but not exclusively, to an antenna assembly in a base station in a microcellular communications system or fixed wireless access system.

BACKGROUND OF THE INVENTION

For modern telecommunications applications, apart from the electrical performance of the antenna other factors need to be taken into account, such as size, weight, cost and ease of construction of the antenna. Depending on the requirements, an antenna can be either a single radiating element or an array of like radiating elements. With the increasing deployment of cellular radio, an increasing number of base stations which communicate with mobile handsets are required. Similarly an increasing number of antennas are required for the deployment of fixed radio access systems, both at the subscribers premises and base stations. Such antennas are required to be both inexpensive and easy to produce. A further requirement is that the antenna structures be of light weight yet of sufficient strength to be placed on the top of support poles, rooftops and similar places and maintain long term performance over environmental extremes.

Antennas for cellular radio systems need to use low cost manufacturing methods. This is particularly important for microcellular and fixed wireless systems where antenna costs can be a significant part of the system costs by virtue of the requirement for a high deployment of base stations.

An antenna with integrated base station control electronics is one type of antenna that reduces the environmental impact of the base station. This type of antenna is known as an integral antenna and can potentially reduce costs both of the antenna and its installation. Further, by being built into the base station the environmental impact of the system is reduced by minimising the number and size of the separate parts. The antenna is also required to be lightweight.

Patch antennas comprise one or more conductive rectilinear or ellipsoidal patches supported relative to a ground plane and radiate in a direction substantially perpendicular to the ground plane. Conveniently patch antennas are formed employing microstrip techniques; a dielectric can have a patch printed upon it in a similar fashion to the printing of feed probes employed in layered antennas.

An antenna for fixed wireless access installations employing patch antenna arrangement is described in PCT Patent Application WO96/19844. The antenna comprises twelve patch elements arranged within a generally octagonal enclosure: the elements are printed on a dielectric sheet suspended between a reflector ground plane and the radome by dielectric spacers. The reflector ground plane has depressions corresponding in position with that of the printed radiating elements, whereby, inter alia, the microstrip feed lines are sufficiently proximate the ground plane to control the feed line radiation, whilst the spacing behind the radiating elements is sufficient to increase the bandwidth of the antenna. The outer dielectric is of formed expanded polystyrene and as such, this spacer will retain moisture which can reduce operating performance. The antenna has relatively large z-axis dimensions (i.e. dimensions in the direction of propagation).

A further type of antenna is known from U.S. Pat. No. 5,499,033 (Northern Telecom), which provides a linear array of radiating elements, employing an essentially tri-plate/layered antenna. Such antennas are typically used in groups with a radome arranged to cover and protect, singly or otherwise, the radiating elements.

OBJECT OF THE INVENTION

The present invention seeks to provide an integral antenna assembly for a microcellular base transceiver station or a fixed wireless access base station.

The present invention further seeks to provide an antenna for a cellular radio transceiver which is aesthetically pleasing, integral, low cost, mechanically rigid and electrically efficient.

STATEMENT OF THE INVENTION

In accordance with a first aspect of the invention, there is provided an integral antenna comprising a radome, a layered antenna and a reflector back plane, wherein the layered antenna has an outer surface and a rear surface; wherein the radome is attached directly to an outer surface of the antenna; and wherein the back plane provides a reflective cavity and encloses the feed network for the antenna and is attached to the rear surface of the antenna. By attaching the backplate directly to the antenna, the antenna structure increases in strength. By attaching the radome directly to the antenna, there is no cavity between the antenna and the radome in which moisture could accumulate. Such moisture would affect the performance of the antenna, both in electrical terms and also in terms of corrosion resistance—it has been found that by positioning the radome adjacent the antenna structure, the radiation pattern is not compromised. Further the construction also provides environmental sealing for the antenna to prevent performance degradation of the antenna during its lifetime due to moisture induced corrosion etc.

Moreover, the present invention can provide an aesthetically pleasing and mechanically strong protective cover for the base station electronics. By having the radome attached to the antenna structure, the overall size of the antenna structure is reduced, with the result that the planning permission required for the installation of such structures is less likely to be refused. The present invention provides a means of increasing the opportunities of constructing an antenna which, when installed, is more likely to blend in with existing architecture. The invention also provides a construction that enables the individual parts of the antenna to serve multiple purposes and hence achieve the requirements of low cost, light weight and efficient RF performance.

The antenna may be a tri-plate structure, comprising two ground planes of which at least one is apertured and a dielectric element which supports a feed network and radiating elements, the dielectric substrate being supported between the two ground planes. The invention is applicable to a wide range of "flat" antenna element types such as slots or cavity backed spirals.

In accordance with another aspect of the invention, there is provided a patch antenna, including a radome, a dielectric substrate having a printed antenna element on a surface thereof and a reflector back plane providing a reflective cavity behind the radiating elements; wherein the radome is attached directly to an outer surface of the dielectric and the reflector back plane is attached to a rear surface of the dielectric substrate. The patch radiating element may be printed on a first side of a dielectric substrate, the patch element being in connection with a microstrip feed therefor on a second side of the substrate and a reflector ground plane; wherein the radome is attached directly to the surface of the dielectric which supports the printed antenna elements, the microstrip feed line being connected through the substrate to the patch, whereby the microstrip feed line lies parallel to the patch, with the patch acting as a ground with respect to the microstrip line. The reflector back plane can be directly attached to the dielectric substrate.

The patches can be rectilinear or ellipsoidal, and can have one or more feeds. Preferably the shielding ground is disposed on the surface of the dielectric which supports the patch element. The patch and ground plane thereby screen the microstrip feed line and distribution network, for any polarisation. This type of feed arrangement can provide an optimum feed point location for any polarisation. In dual polarised mode, there is no compromise in either cross polar performance nor impedance matching.

A matching network can be disposed on the antenna dielectric. Preferably, this network is positioned on an opposite side of the dielectric to and shielded by the ground plane. By the use of microstrip printing techniques a patch antenna can be simply and cost effectively manufactured; fewer process steps are involved in production and microstrip techniques are well developed. The matching network can be formed with discrete components.

In accordance with a further aspect of the invention, there is provided an integral antenna comprising a radome, a dielectric substrate having a patch antenna element on a surface thereof and a reflector back plane providing a reflective cavity behind the radiating element; wherein the radome is attached directly to an outer surface of the dielectric and the reflector back plane is attached to a rear surface of the dielectric substrate. The patch radiating element can be printed on a first side of the dielectric substrate; wherein theradome is attached directly to the surface of the dielectric which supports the printed antenna elements, the patch being connected through the substrate to a microstrip feed line, whereby the microstrip feed line lies parallel to the patch, with the patch acting as a ground with respect to the microstrip line.

There is provided a method of operating an integral antenna comprising a radome, a dielectric substrate having an antenna element on a surface thereof and a reflector back plane providing a reflective cavity behind the radiating element; wherein the radome is attached directly to an outer surface of the dielectric and the reflector back plane is attached to a rear surface of the dielectric, the antenna being connected through the substrate to a radio frequency feed line, wherein the antenna transmits and receives signals via the feed network.

In accordance with another aspect of the invention, there is provided a method of operating an integral antenna comprising a radome, a dielectric substrate having a patch antenna element on a surface thereof and a reflector back plane providing a reflective cavity behind the radiating element; wherein the radome is attached directly to an outer surface of the dielectric and the reflector back plane is attached to a rear surface of the dielectric, the patch being connected through the substrate to a microstrip feed line, whereby the microstrip feed line lies parallel to the patch, with the patch acting as a ground with respect to the microstrip line, wherein the antenna transmits and receives signals via the feed network.

DESCRIPTION OF THE DRAWINGS

In order that the present invention can be more fully understood and to show how the same may be carried into effect, reference shall now be made, by way of example only, to the Figures as shown in the accompanying drawing sheets wherein.

DETAILED DESCRIPTION OF THE PREFERRED EMBODIMENTS

There will now be described by way of example the best mode contemplated by the inventors for carrying out the invention. In the following description, numerous specific details are set out in order to provide a complete understanding of the present invention. It will be apparent, however, to those skilled in the art that the present invention may be put into practice with variations of the specific.

Figure 1:
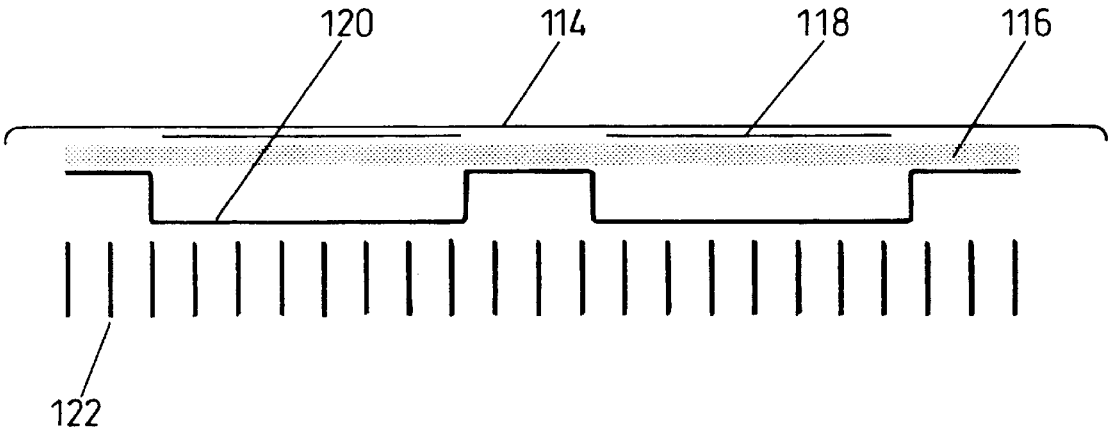
FIGS. 1 and 2 show the diagrammatic construction of an antenna assembly made in accordance with the invention.
Figure 2:
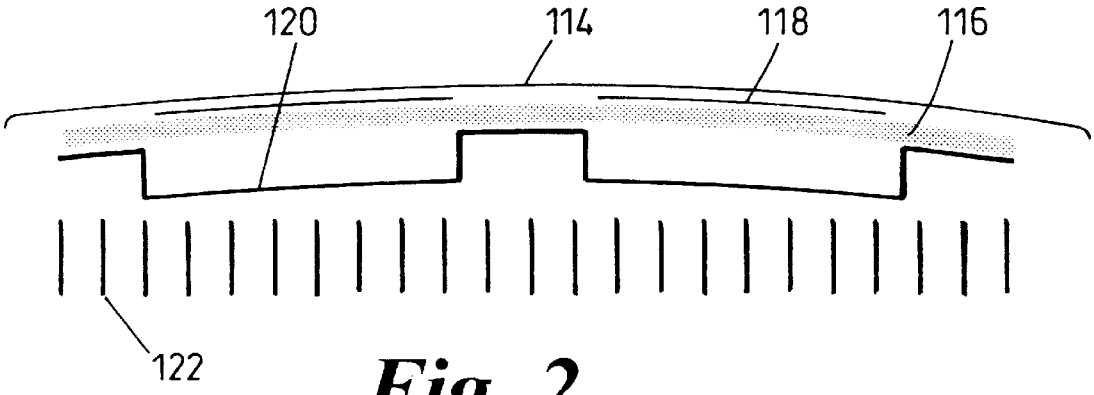

FIGS. 1 and 2 show two arrangements for an integral antenna in accordance with the invention. The cover may be either flat or curved. A curved surface is often used to provide greater structural strength and is regarded by many to be more pleasing to the eye. The antennas comprise a radome 114, a dielectric board 116 with a patch antenna 118 defined thereon and a shaped reflector ground plane 120. The radome is manufactured using a suitable dielectric material such as glass fibre reinforced plastics or ABS plastics and is shaped to conform with the radiating elements and can be coloured to provide an aesthetically pleasing cover. This cover can also act as a solar shield to reduce the effects of solar radiation heating and an impact shield to prevent mechanical damage to the base station electronics. There is a wide choice of such materials available known to practitioners of the art. The reflector ground plane or backplate is conveniently formed from aluminium to provide a lightweight structure, although materials such as zinc plated steel can also be employed. Optional heat sink fins 122 are shown and are in intimate contact with the ground plane, although this particular detail is absent from the Figures. The back plate provides the reflecting ground plane for the cavities under the patch antennas, although in these Figures, the cavity depth is larger than would normally be the case for sub—2 GHz signals. The back plate can be glued to the printed circuit board using an adhesive such as a TESA adhesive system (such as types 4965 or 4970). Ground contact must be maintained. Similarly the radome can be glued to the radiating side of the printed circuit board. The formed back offers environmental protection and can provide a seal against moisture ingress at the edges.

Microstrip losses and board control ($\epsilon_{64}$ and $\tan\partial$)) are tolerable with the use of Getek (TM) at both 900 and 1800 MHz. Getek board is an alternative to FR-4 board, and provides a board with a reasonable degree of control on dielectric constant spread. No foam is employed, which can retain water; the radome is strengthened by the dielectric and back plane. A variety of feed methods can be employed for the antenna elements to achieve both match and dual polarisation. The absence of foam spacers assists in increasing mechanical strength together with the shaped back plate. In addition to providing environmental protection against moisture etc., the shaped back plate provides an integrated cable run and strain relief, dispensing with the need for cable connectors and clips.

Figure 3:
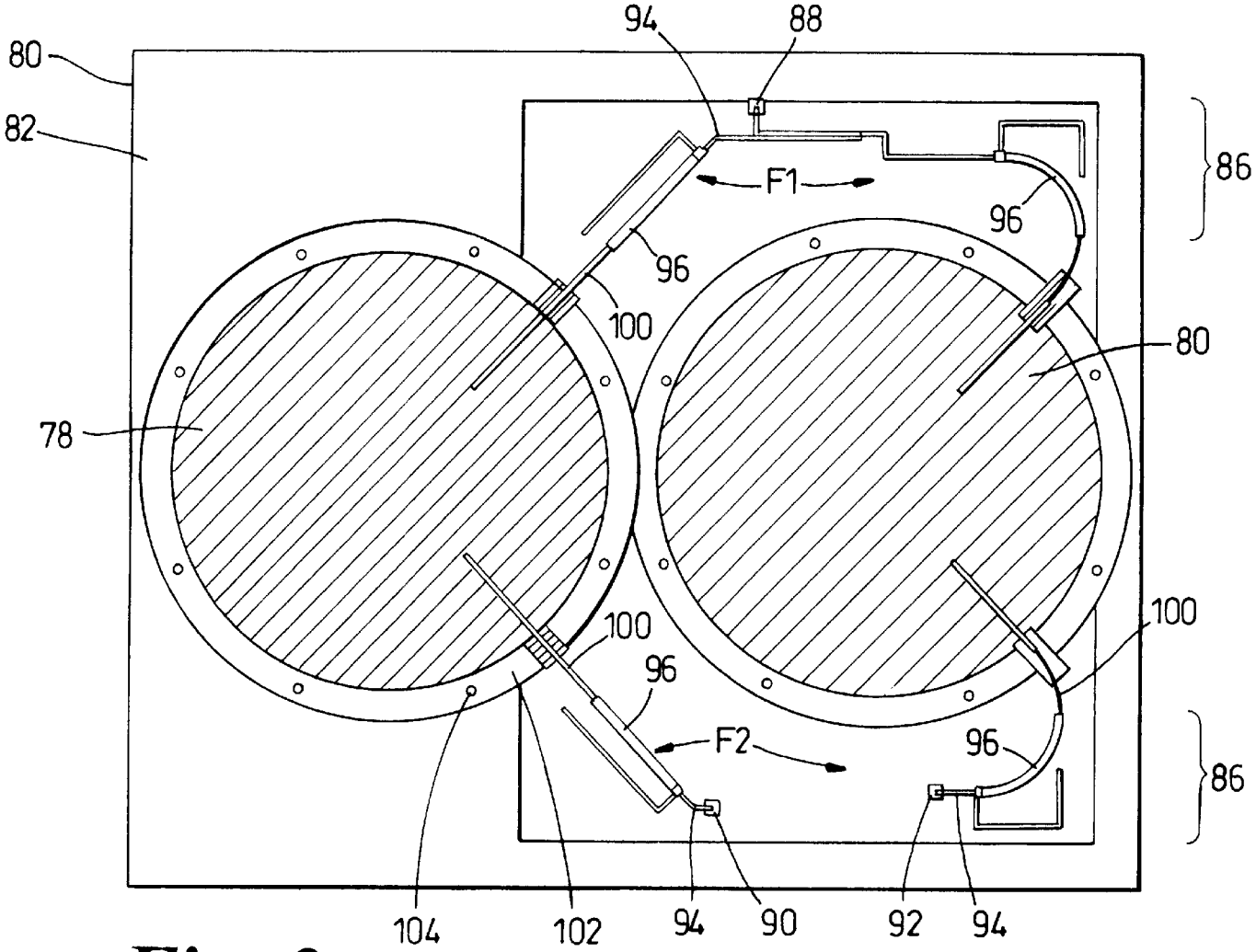
FIG. 3 shows the layout of a first antenna.

Referring now to a particular antenna configuration, FIG. 3 shows a first antenna. Two circular patches were chosen to reserve space for a distribution network, especially since square patches at ±45° would increase the width and length of an integral antenna. The antennas are operable in both transmission and reception at two orthogonal polarisations and exhibit a suitable antenna pattern. FIG. 3 shows the patches 78, 80 and ground plane 82 on a first side of a dielectric substrate 84 and microstrip lines/feed network 86 on a second side of the dielectric. For reasons of convenience, FIG. 3 shows two types of microstrip feed lines for the patches. A first type of feed F1 provides the connection to the patches of a first polarisation and two separate feeds F2 provide the connection to the patches for the other polarisation. The feeds F2 can be fed independently, which is not the case for feeds F1. Solder pads 88, 90, 92 provide contact points to receive input signals from, for example, a coaxial cable. The microstrip arms 94 have a first width, a second width 96 for matching purposes, and a third width 100 as they pass under the patches 78, 80. In the figure, the periphery of the patches have a plated annular region 102 on the side opposite to the patches with positions 104 indicated for the placement of fastening screws, or the like, whereby the dielectric may be securely fastened to a formed reflecting back plane, not shown.

One important feature of this board is that the patch radiating element is positioned on a front surface of the board, which patch acts as a ground plane for the microstrip feed network directly opposite the patch. This arrangement provides isolation for the feed network. The patches or alternative radiating elements can be printed on either side of the circuit board according to the detailed antenna design, but this could compromise the efficiency of the radiating elements. This type of feed arrangement can provide an optimum feed point location for any polarisation. In dual polarised mode, there is no compromise in cross polar performance.

The shape of the earthed reflecting plane provides a cavity behind the radiating elements, which largely determines the bandwidth of the antenna in operation and provides shielded distribution cavities which act as a screen for the distribution network (no stray microstrip radiation) and the microstrip-cable transition section, and allowing the microstrip network to be located on the rear side of the board, thus protecting it from radome effects. The distance of the ground plane from the microstrip lines is such that the microwave signals propagate in a microstrip transmission mode as opposed to a stripline transmission mode. This is true for the microstrip tracks passing between the cavity area to the microstrip track-cable transition area. For a cellular radio antenna intermodulation performance is critical; thus in this particular case semi rigid copper jacketed cables are used that have been covered with a heat-shrink insulating sleeve. These cables are preformed to match the meanders in the cable retention features of the backing plate. Both the inner and outer of the cable is soldered to the antenna circuit board. This design therefore provides several advantages.

If the radiating elements are patches, then these can be printed by standard techniques onto the dielectric. The patch and the feed network can be manufactured in one process. The distance of the patches to a reflector ground plane is a compromise between bandwidth and space constraints. For certain applications, where a low profile antenna is required, patch antennas provide a good bandwidth. In order to provide a suitable matching network without incurring too much loss, a design having a spacing below the patch with respect to the reflector ground plane was set at 13 mm, for the 900 MHz GSM band, by conforming the antenna element and the heat sink units behind it with the protective radome. This depth may be varied for other frequencies such as the 1800 and 1900 MHz bands.

Dual polarisation can be employed to provide one form of diversity. This can be implemented using two polarisations at ±45°. On the receive side, polarisation diversity using techniques such as maximal ratio combining techniques (other types of combining are possible) helps to overcome propagation fading. Pattern broadening can be employed by feeding a second azimuth element in anti-phase and at reduced amplitude. If two patches are employed, then they should be positioned closely adjacent each other to prevent too big a dip on broadside of the azimuth pattern. For one embodiment, a separation distance of about 0.7λ was chosen, which provided a 100° beamwidth with a 3 dB dip.

Figure 4:
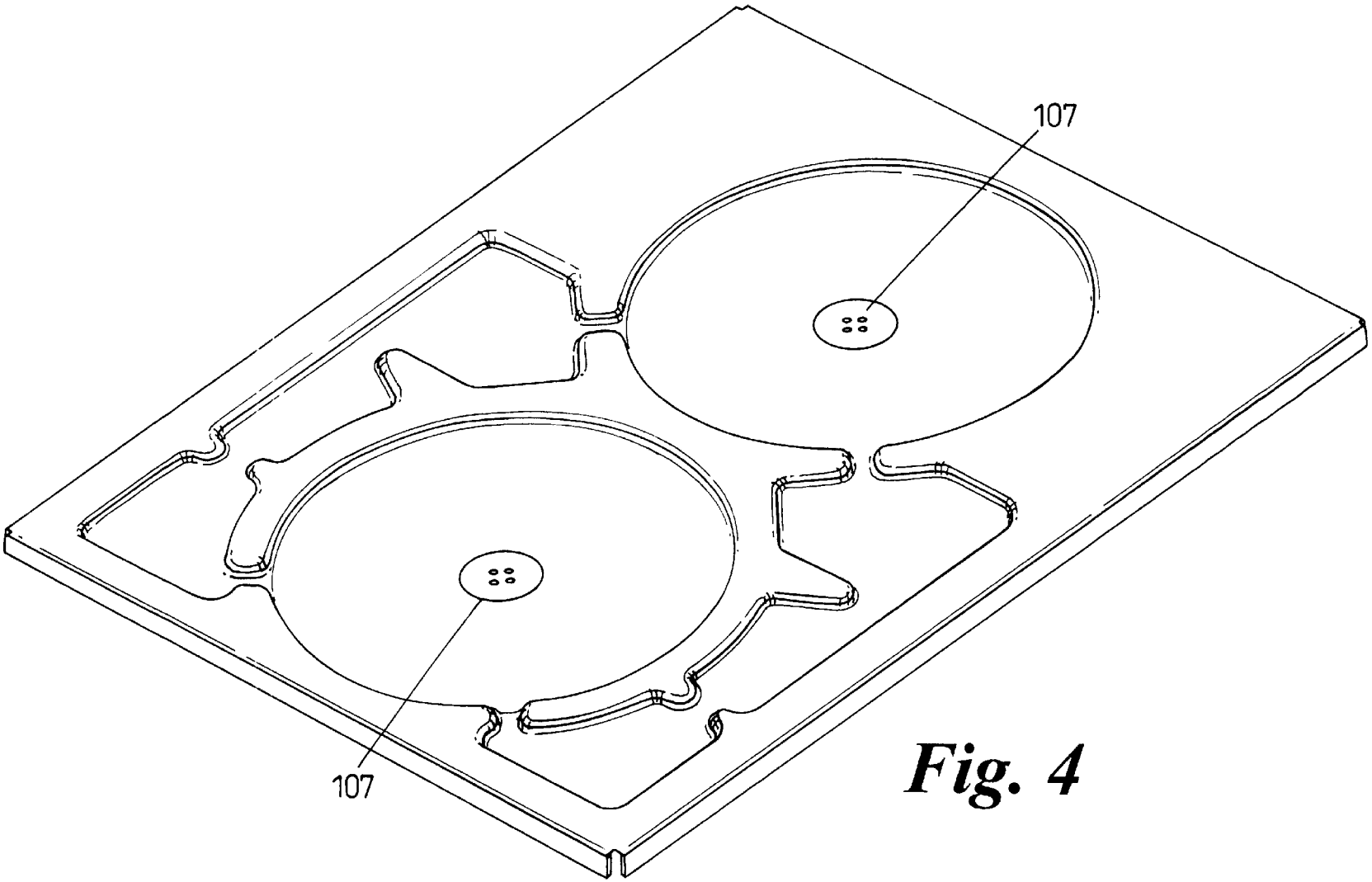
FIG. 4 shows in perspective view, a shaped ground plane, operable with the embodiment shown in FIG. 3.

FIG. 4 shows in perspective view, an example of a shaped ground plane, suitable for use with the antenna shown in FIG. 3. The size and shape of the features are determined by the electrical and mechanical requirements of the antenna. In the example shown two large circular depressions 108 and 110 are formed to provided a suitable backing cavity for the two patch elements 78 and 80 shown on the circuit board in FIG. 3. The depth of these depression is tightly controlled according to the electrical requirements of the patch design. The second important feature pressed into the sheet are the cavities 109 and 111 whose depth is again controlled. These two features serve to provide a cover for the microstrip feed networks F1, F2 shown in FIG. 4. Further depressions in the back plane provide an integral feed cable retaining and stress relief structure. The depth of the pressing in this area is made to suit the outer diameter of the cable plus any insulating jacket material. The depths of the structure in each of the areas shown may be different depending on detailed implementation. In the particular implementation shown the depths of the cable retention areas and matching network areas have been made identical for ease of tooling. The cavity areas have a greater depth needed to meet the electrical performance requirements of the antenna. The edges of the backing plate have been orthogonally formed with respect to the plate to provide additional mechanical rigidity. The drawing shown is for a flat antenna structure although the antenna backing plate can, however, easily be formed to match the shape of the front cover whether of a single or double curvature.

The small holes 107 at the centre of the depressions in the back plate are sealed with a semi permeable membrane such as GORETEX (RTM) to allow the assembly to breath and prevent condensation within the antenna. Using suitable common features to provide alignment the three main structural parts the unit are pressed and bonded together with an adhesive film. The antenna cable feed holes are then sealed with a suitable sealant. After assembly the backing plate provides significant structural stiffening of the front cover making the whole assembly extremely rugged and capable of withstanding significant impact loads. The back plane also provides mechanical strength directly to the printed layer and radome and can contain an integrated cable run and strain relief. Apertures are provided (not shown) for access into the cavity by the cables. The integrated assembly brings the antenna radiating elements into close contact with the radome, avoiding problems with spacing tolerances and moisture ingress.

The formed rear cover plate provides features to act as cavities for the patch antenna elements and a cover to shield the feed network both from the environment and electrical interference. The antenna assembly thus provided has an integral rigid structure, without metal/metal contacts that can generate intermodulation products.

Figure 5:
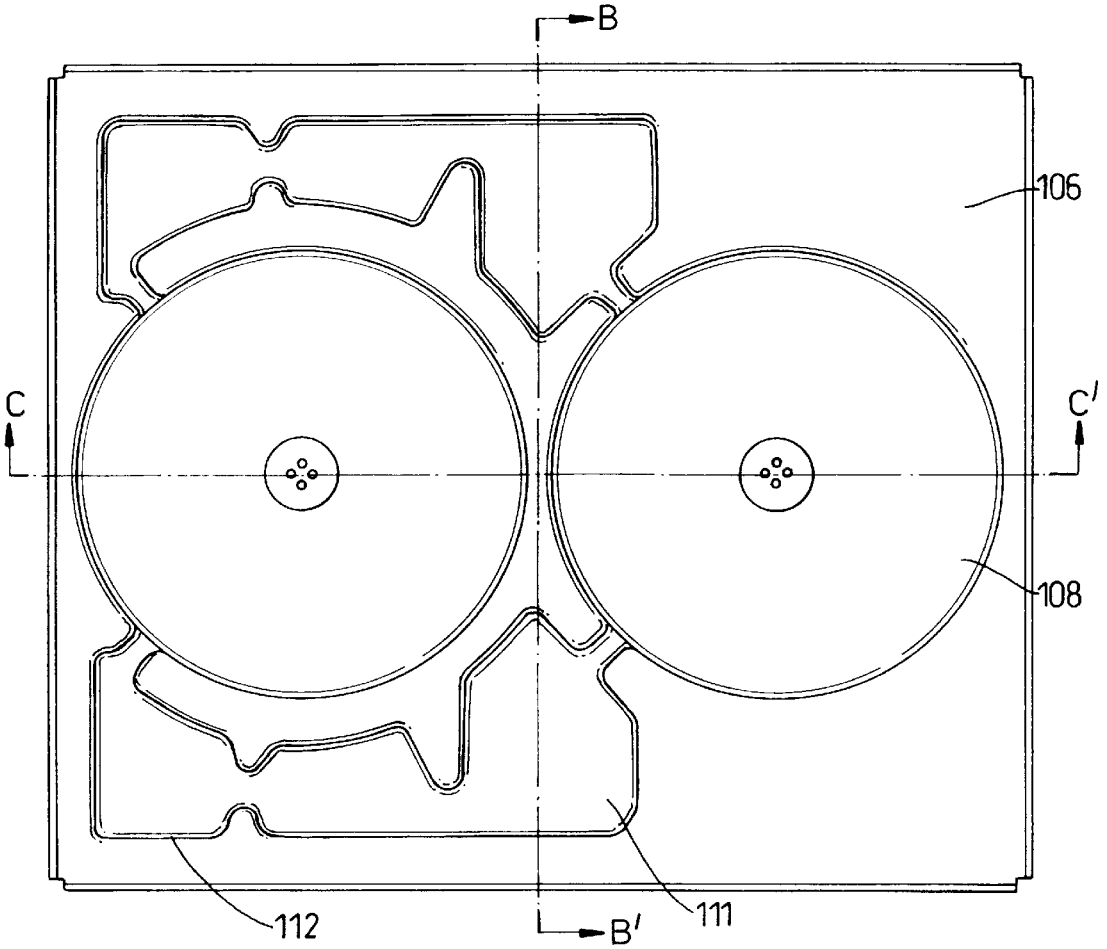
FIG. 5 is a plan view of the antenna shown in FIG. 4.
Figure 6A:
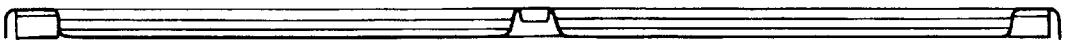
FIGS. 6*a*, 6*b* and 6*c* are cross-sections through FIG. 5 along the lines C–C', B–B' and E–E', respectively.
Figure 6B:
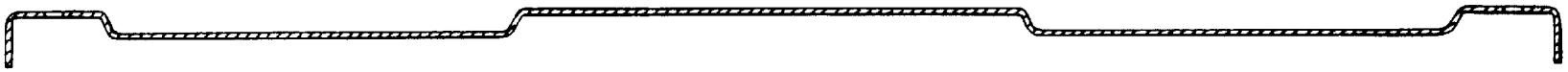
Figure 6C:
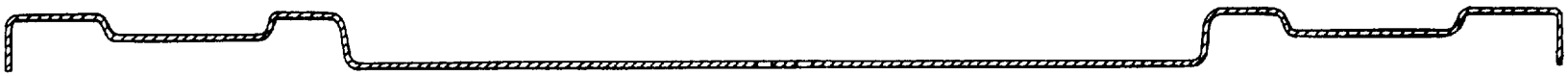

Referring now to FIG. 5, there is shown a plan view of the antenna back plane 106 as shown in FIG. 4, with FIGS. 6*a*, 6*b* and 6*c* being cross-sections through FIG. 5 along the lines C–C', B–B' and E–E', respectively. Circular depressions 108 and 110 form the cavities behind patches 78 and 80. Radiussed edges 112 provide the transition from the reflecting portions to the areas which contact the dielectric. The back plane is preferably pressed out of aluminium sheet having a thickness, typically, of about 1–2 mm. This thickness affects the radii of the cavities. As can be seen, the depressions provide convenient shielding areas for the microstrip feed networks. The depth of the cavity provides an increase in bandwidth, whilst the non-dished part offers mechanical support.

Figure 7:
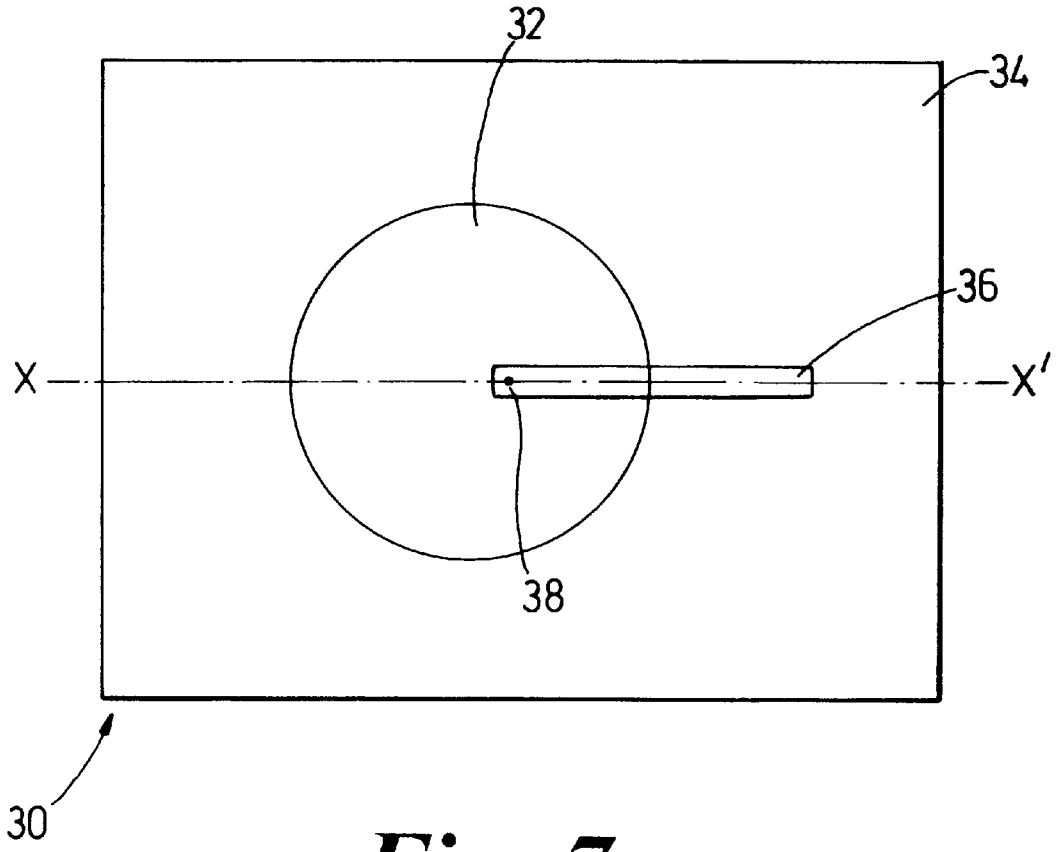
FIGS. 7 and 8 show detailed plan and cross-sectional views of a first patch configuration.
Figure 8:
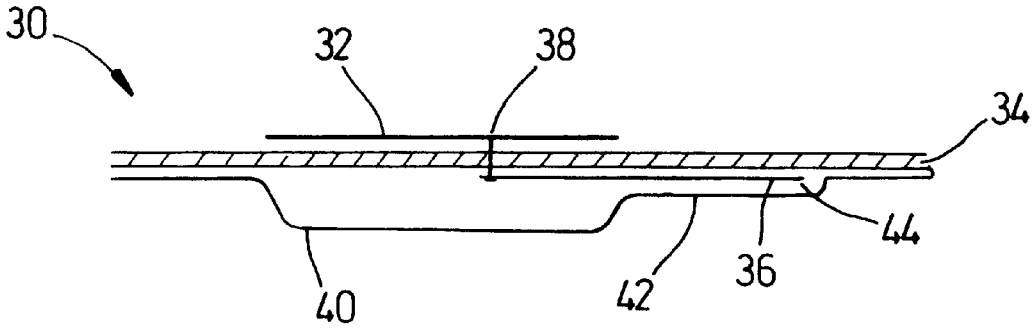

Referring now to FIGS. 7 and 8, there is shown a plan view and a cross-sectional view (through X–X' of FIG. 7) of a first embodiment made in accordance with the invention. The patch antenna 30 comprises a patch 32, supported on a first side of a dielectric 34. A microstrip feed 36 is printed on the other side of the dielectric and is in contact with the patch by means of a plated via 38 or similar. The patch is preferably placed a distance from a reflective ground plane 40, as is shown. Signals are fed to the patch by the microwave feed line 36 in a microstrip mode of transmission, with the patch 32 acting as a ground with respect to the microstrip line, when the microstrip line is opposite the patch. Microstrip line 36 is prevented from radiating and causing interference when not opposite the patch by shielding ground means 42, which is a shaped part of reflector plane 40. The microstrip line is fed from a cable and the microstrip line will be of a form such that it provides a suitable matching circuit between the cable and the patch, with regard to, inter alia, the dielectric constant of the board and the radome spacing. Typically the cable is a semi-rigid coaxial cable and is soldered to a via hole where contact is made with the microstrip metal, which is typically a copper alloy. For a 150 mm diameter patch, the cavity under the patch, in the grounded reflector back plane, would be approximately 160 mm, with the spacing between the patch and back plane being around 30 mm.

Figure 9:
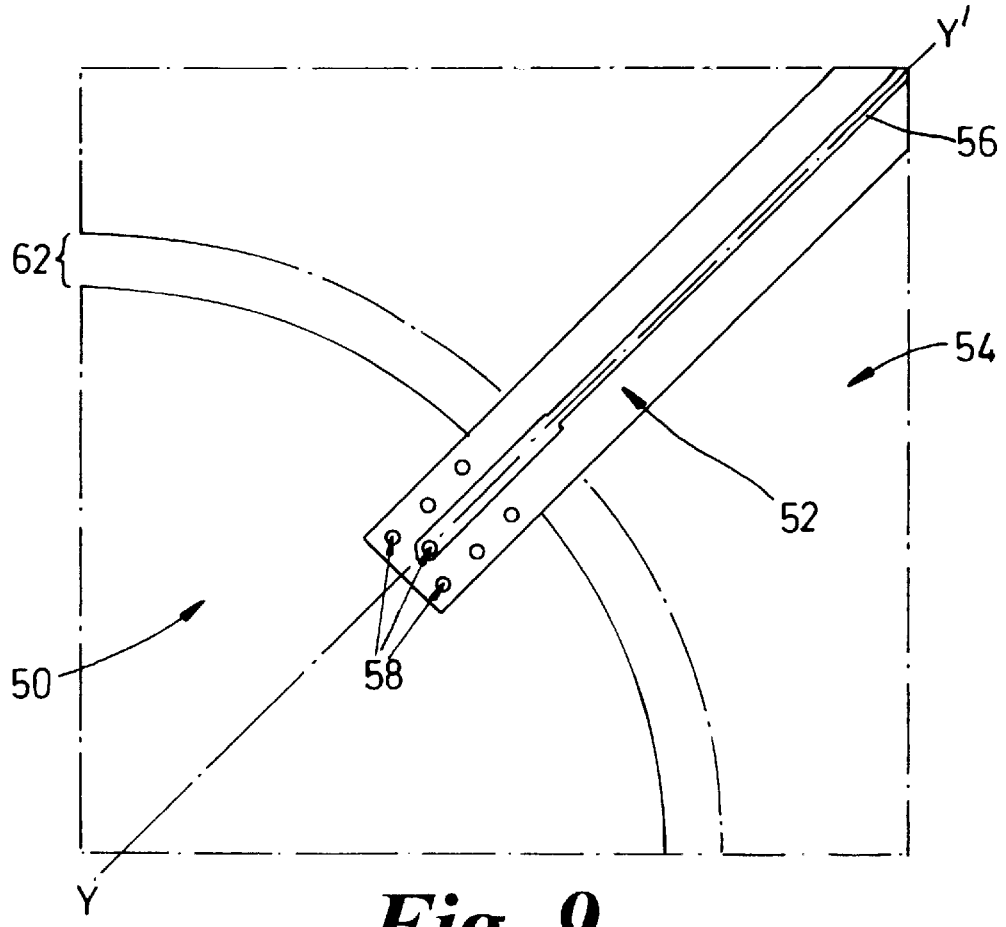
FIGS. 9 and 10 show detailed plan and cross-sectional views of a second patch configuration.
Figure 10:
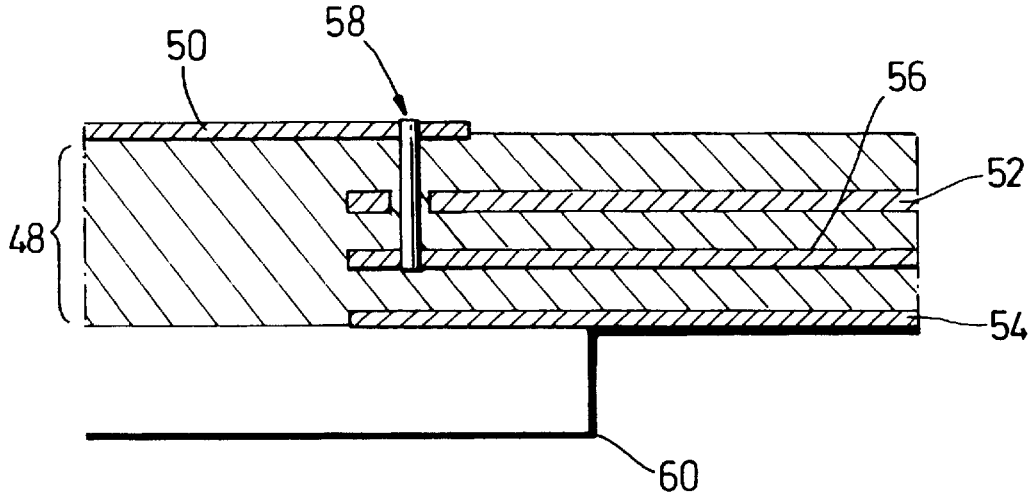

FIGS. 9 and 10 show a quadrant of a second embodiment in plan and cross-sectional views (through Y–Y' of FIG. 9). The dielectric 48 is a four-layer board, having a patch antenna 50 on a first (upper) layer, ground planes 52, 54 in the areas outside the patch, on the fourth and second layers and a micro/stripline (buried layer) 56 screened and thus non-radiating between the two ground planes, protected from the radome effects and the environment. Vias 58 provide a feed and mode suppression means for the feed between the microstrip line and the patch. A reflecting back plane 60 is provided, which is connected to ground by direct contact to the lower ground plane. A boundary 62 can be defined between the patch and the ground plane.

Figure 11:
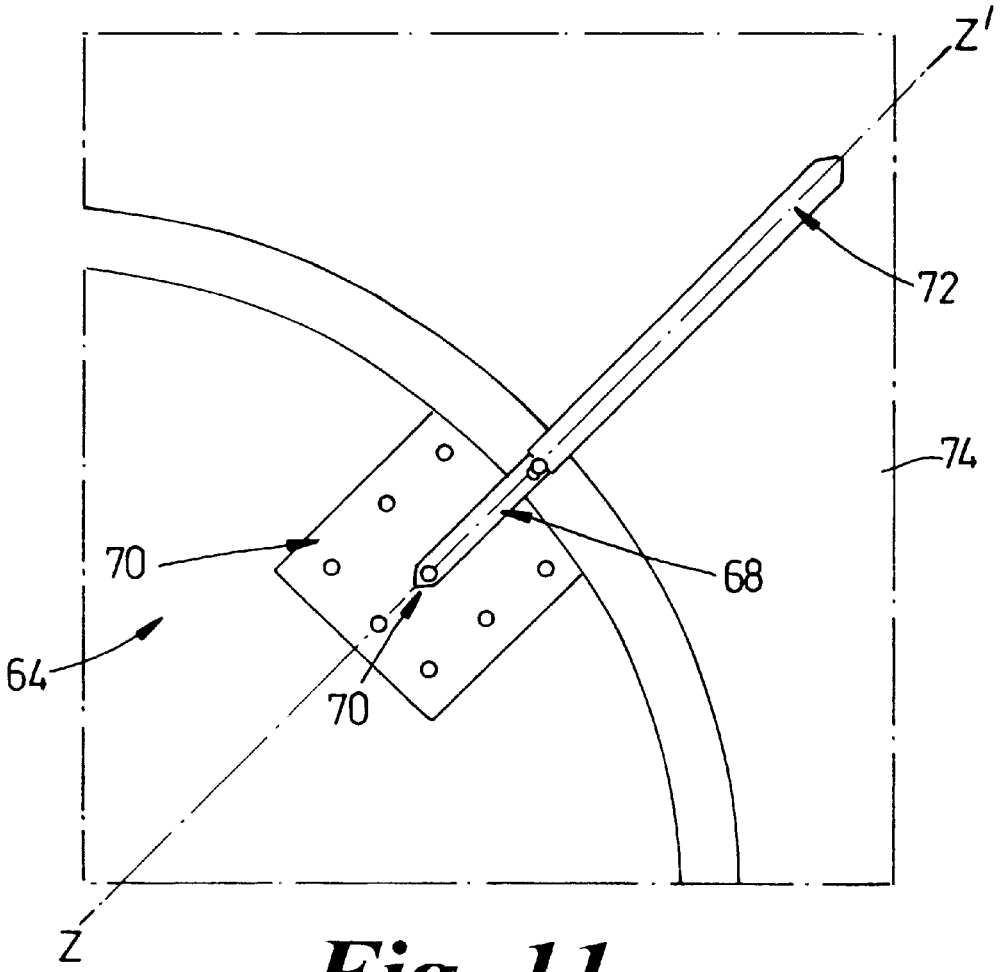
FIGS. 11 and 12 show detailed plan and cross-sectional views of a third patch configuration; and, FIG. 13 shows a further embodiment of the invention.
Figure 12:
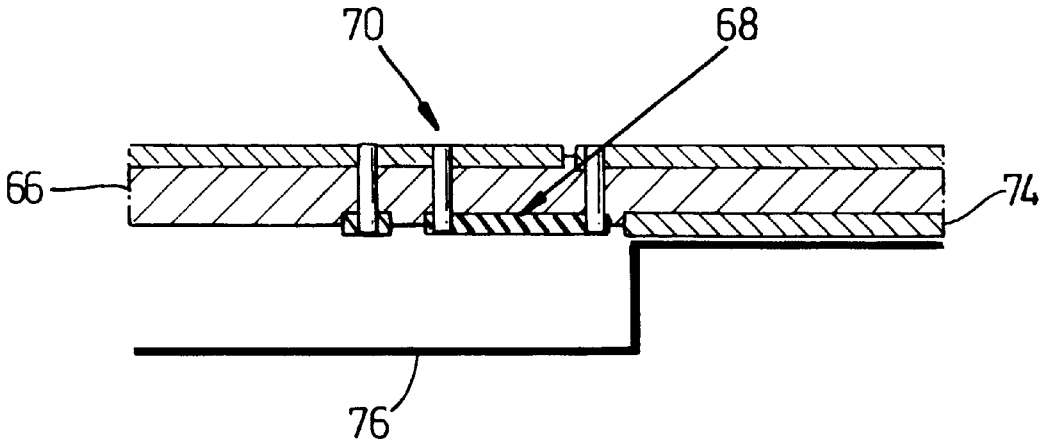

FIGS. 11 and 12 show a still further embodiment, again in plan and cross-sectional views (the cross-section being through Z–Z' in FIG. 11). In this embodiment, which includes a circular patch 64 printed upon a single dielectric 66, the microstrip feed 68 continues only for a short distance on the opposite side of the dielectric relative to the patch. Vias 70 are provided to transfer the microwave signals from an input microstrip line 72 to the underside feed microstrip line 68. For convenience the upper microstrip to lower microstrip transition is made in the region between the ground plane 74. Again, a reflector plane 76 is also present. Ground plane 74 is provided to ensure microstrip transmission mode for microstrip line 72. A further ground plane portion to shield the microstrip line fields above the dielectric may be appropriate.

Figure 13:
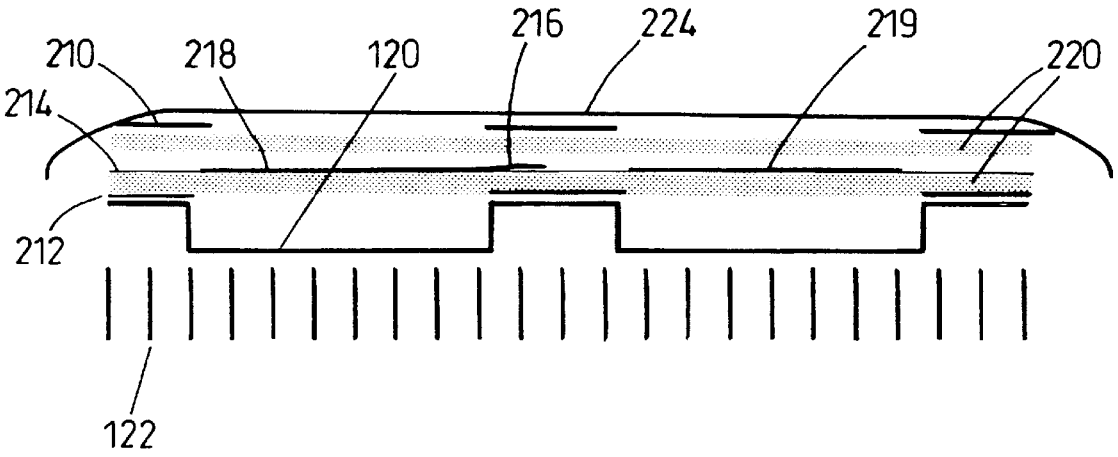

FIG. 13 shows a further embodiment of the invention wherein the antenna is a triplate structure comprising two apertured ground planes 210, 212 and a dielectric element 214 which supports a feed network 216 and radiating elements 218, 219, the dielectric substrate being suspended between the two ground planes. The dielectric substrate can be supported by dielectric support 220. The radome 224 is attached directly to the outer ground plane 210.

We claim:

1. An integral antenna comprising a radome, a layered antenna and a reflector backplane, wherein the layered antenna has an outer surface and a rear surface; wherein an inner surface of the radome is attached directly and continuously to the outer surface of the antenna, whereby there is no cavity between the layered antenna and the radome; and wherein the backplane provides a reflector cavity and encloses the feed network for the antenna and is attached to the rear surface of the antenna.

2. An integral antenna according to claim 1 wherein the antenna is a tri-plate structure, comprising two apertured ground planes and a dielectric element which supports a feed network and radiating elements, the dielectric substrate being supported between the two ground planes.

3. An integral antenna comprising a radome, a dielectric substrate having a patch antenna element on a surface thereof and a reflector backplane providing a reflective cavity behind the patch antenna element; wherein an inner surface of the radome is attached directly and continuously to an outer surface of the dielectric substrate, whereby there is no cavity between the patch antenna element and the radome and the reflector backplane is attached to a rear surface of the dielectric substrate.

4. An integral antenna according to claim 3 wherein the patch antenna element is printed on a first side of the dielectric substrate; wherein the radome is attached directly to the surface of the dielectric which supports the printed patch antenna elements, the patch antenna element being connected through the substrate to a microscope feed line, whereby the microscope feed line lies parallel to the patch antenna element, with the patch antenna element acting as a ground with respect to the microscope line.

5. An integral antenna according to claim 3 wherein the reflector back plane is directly attached to the dielectric substrate.

6. An integral antenna according to claim 3 wherein the patch antenna element can be rectilinear or ellipsoidal.

7. An integral antenna according to claim 3 wherein the patch antenna element has one or more feeds.

8. An integral antenna according to claim 3 wherein the reflector back plane is disposed on the surface of the dielectric substrate opposite to the surface which supports the patch antenna element, whereby the patch antenna element and reflector back plane screen a microstrip feed line and distribution network.

9. An integral antenna according to claim 3 wherein the back plane includes a reflector cavity and encloses a feed network for the patch antenna element.

10. A method of operating an integral antenna comprising a radome, a dielectric substrate having an antenna element on a surface thereof and a reflector backplane providing a reflective cavity behind the radiating element; wherein an inner surface of the radome is attached directly and continuously to an outer surface of the dielectric substrate and the reflector backplane is attached to a rear surface of the dielectric substrate, whereby there is no cavity between the antenna element and the radome, the antenna being connected through the substrate to a radio frequency feedline, wherein the antenna transmits and receives signals via the feed network.

11. A method of operating an integral antenna comprising a radome, a dielectric substrate having a patch antenna element on a surface thereof and a reflector backplane providing a reflective cavity behind the radiating element; wherein an inner surface of the radome is attached directly and continuously to an outer surface of the dielectric substrate and the reflector backplane is attached to a rear surface of the dielectric substrate, whereby there is no cavity between the layered antenna and the radome the patch antenna element being connected through the substrate to a microstrip feed line, whereby the microstrip feed line lies parallel to the patch antenna element, with the patch antenna element acting as ground with respect to the microstrip line, wherein the antenna transmits and receives signals via the feed network.

* * * * *